US010103444B2

(12) United States Patent
Wangsvick

(10) Patent No.: US 10,103,444 B2
(45) Date of Patent: Oct. 16, 2018

(54) CONFORMAL BROADBAND DIRECTIONAL ½ FLARED NOTCH RADIATOR ANTENNA ARRAY

(71) Applicant: Raytheon Company, Waltham, MA (US)

(72) Inventor: Chad Wangsvick, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 584 days.

(21) Appl. No.: 15/092,074

(22) Filed: Apr. 6, 2016

(65) Prior Publication Data

US 2018/0013203 A1 Jan. 11, 2018

(51) Int. Cl.

| | |
|---|---|
| ***H01Q 1/28*** | (2006.01) |
| ***H01Q 13/02*** | (2006.01) |
| ***H01Q 1/52*** | (2006.01) |
| ***H01Q 1/42*** | (2006.01) |

(52) U.S. Cl.

CPC ..... *H01Q 13/0208* (2013.01); *H01Q 1/281* (2013.01); *H01Q 1/42* (2013.01); *H01Q 1/523* (2013.01)

(58) Field of Classification Search

CPC ..... H01Q 1/281
USPC ..... 343/705
See application file for complete search history.

(56) References Cited

U.S. PATENT DOCUMENTS

| | | | |
|---|---|---|---|
| 5,023,623 | A | 6/1991 | Kreinheder et al. |
| 5,220,330 | A | 6/1993 | Salvail et al. |
| 6,043,785 | A | 3/2000 | Marino |
| 6,407,711 | B1 | 6/2002 | Bonebright et al. |

OTHER PUBLICATIONS

Sun et al., "A Broadband Conformal Phased Array Antenna on Spherical Surface," International Journal of Antennas and Propagation, vol. 2014, ARticle ID 206736, 5 pages, 2014.
Augustin et al, "Performance of an Original Microstrip Ring Array Antenna Lied on a Conical Structure," Antennas and Propagation, Apr. 4-7, 1995, Conference Publication No. 407,O IEE 1995.
Liu et al., "A 35GHz Cone Conformal Microstrip 4×4 Array," Proceedings of Asia-Pacific Microwave Conference 2007.
Artiga et al., "Halved Vivaldi Antenna With Reconfigurable Band Rejection," IEEE Antennas and Wireless Propagation Letters, vol. 10, 2011, pp. 56-58.

*Primary Examiner* — Graham Smith
(74) *Attorney, Agent, or Firm* — Eric A. Gifford

(57) ABSTRACT

An antenna array includes a plurality of ½ flared notch radiators recessed within a missile nose cone and positioned in a circumferential arrangement around and extending radially from the payload's metal skin to contact an annular metal cover that provides a ground plane such that each ½ flared notch radiator is inclined towards the boresight axis. The payload's metal skin provides an image plane for each ½ flared notch radiator to launch RF energy with a radial polarization normal to the image plane forward through the annular RF radome. Each ½ flared notch radiator may be positioned within a 5½ sided waveguide to further improve directionality and isolation.

19 Claims, 8 Drawing Sheets

CONFORMAL BROADBAND DIRECTIONAL ½ FLARED NOTCH RADIATOR ANTENNA ARRAY

BACKGROUND OF THE INVENTION

Field of the Invention

The present invention relates to antenna arrays, and more particularly to conformal broadband directional antenna arrays useful for missile nose cones.

Description of the Related Art

U.S. Pat. No. 5,023,623, entitled "Dual Mode Antenna Apparatus Having Slotted Waveguide and Broadband Arrays," by Donald E. Kreinheder et al., the entire contents of which are incorporated herein by this reference, provides a description of conventional missile target detection and tracking systems. Briefly, one type of target tracking system is known as broadband anti-radiation homing (ARH). Such a system is passive, and tracks a target by receiving radiation emitted by the target.

Known conformal arrays for missiles employ conformal slot radiators and microstrip patch radiators. See Min Liu et al., "A 35 GHz Cone Conformal Microstrip 4×4 array" Proc. Of Asia-Pacific Microwave Conf. 2007 and D. Augustin et al., "Performance of an Original Microstrip Ring Array Antenna Lied on a Conical Structure" Antennas and Propagation $9^{th}$ International Conf. 1995. These antennas are narrow band (e.g., a few % of the center frequency), and because of their physical and/or electrical characteristics they can not be inclined to enhance their forward radiation. The result is a limited field of view.

Conventional conformal mounting situates the antenna elements so they face normal to the missile surface resulting in poor radiation in the forward direction. This is because the antenna is situated so that the greatest amount of energy from each element is directed normally to the missile body. This makes radiation in the forward direction difficult. The problem is made worse for elements radiating with an E-field tangential to the metallic missile body. The metal surface will not support these fields and forces them to zero at the point of contact. This is a major problem for conformal arrays since their "view" to missile boresight is tangential from the cylindrical section and nearly tangential in the nose region.

U.S. Pat. No. 5,220,330, entitled "Broadband conformal inclined slotline antenna array" by Gary Salvail et al., which is hereby incorporated by reference, provides a description of a missile guidance antenna that is conformal to the missile surface, dual-polarized and broadband. An array uses broadband antenna elements with both the E and the H-plane elements inclined toward boresight to improve directivity in that direction. Any inclination angle between 0 and 90 degrees may be used in accordance with the invention, although 30° and 90° are preferred inclination angles. This offsets the nullifying effects of the metallic skin in the H-plane as well as enhances the performance of the E-plane. Tilting the elements also makes the antenna more compact, which helps in adapting it to conformal use. The antenna uses slotline (notch) elements, which have a flat profile. These elements are suitable for close packing in both the E and H-planes to prevent grating lobes in the antennas' field of view while the antenna is scanned to boresight. Slotline (notch) elements are broadband with greater than three-to-one bandwidths being achieved. Dual polarization is accomplished by combining the E and H-plane elements in a linear or circumferential manner. A single or dual polarized array can be mounted on the cylinder section, on the nose, or radially around the missile body. In the radial configuration, the elements still incline in the boresight direction. Any combination of array positions is possible. The slotline elements can be packed with spacing close enough to allow for electronic beam steering without creating grating lobes at the highest frequency of operation.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a conformal broadband directional antenna array for a missile that is compact and exhibits a desired radiation pattern inclined towards boresight.

In an embodiment, a missile nose cone has a payload (e.g., an optical or RF seeker, propellant, explosive or kinetic warhead) having a metal skin with a circular cross section normal to the boresight axis. An annular RF radome encircles the payload. An annular metal cover is positioned around and aft of the annular RF radome. An antenna array comprises a plurality of ½ flared notch radiators recessed within the nose cone and positioned in a circumferential arrangement around and extending radially from the payload's metal skin to contact the annular metal cover that provides a ground plane such that each ½ flared notch radiator is inclined towards the boresight axis. The payload's metal skin provides an image plane for each ½ flared notch radiator to launch RF energy with a radial polarization normal to the image plane forward through the annular RF radome.

In an embodiment, the compact antenna array occupies less than 50% of the volume of the nose cone.

In an embodiment, the image plane creates an image of each ½ flared notch element that together approximate a full flared notch element. The image plane and said ground plane each have a circular cross-section normal to the boresight axis.

In an embodiment, the payload is cylindrical about the boresight axis. Each ½ flared notch radiator launches RF energy that is nominally parallel to the boresight axis.

In an embodiment, the payload is conical about the boresight axis. Each ½ flared notch radiator launches RF energy that is inclined to the boresight axis at angle $\alpha$ where 0 degrees$<\alpha<$90 degrees.

In an embodiment, each ½flared notch radiator includes a section that extends radially beyond the RF aperture to contact the ground plane.

In an embodiment, RF absorbing material is positioned aft of each ½ flared notch radiator both behind and radially beyond the RF aperture. RF absorbing material may also be positioned on the walls of the septums between radiators.

In an embodiment, each ½ flared notch radiator is confined in a 5½ sided waveguide that both confines the RF energy to be launched forward through the RF aperture and isolates adjacent ½ flared notch radiators. The payload's metal skin, an annular metal backplane, a pair of metal septums (sidewalls) to either side of the radiator and the annular metal cover define the 5½ sided waveguide. The septum-to-septum spacing is such that a cutoff frequency fc of the waveguide is below a useable bandwidth of the antenna array.

In an embodiment, a single ½ flared notch radiator in a 5½ sided waveguide is positioned to launch RF energy inclined to the missile's longitudinal axis backward through an RF window formed in the missile body. This configuration may, for example, be used as a data link antenna. The missile fuselage provides a ground plane, which has a circular cross section, opposite the image plane, which may be flat or have a circular cross section.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
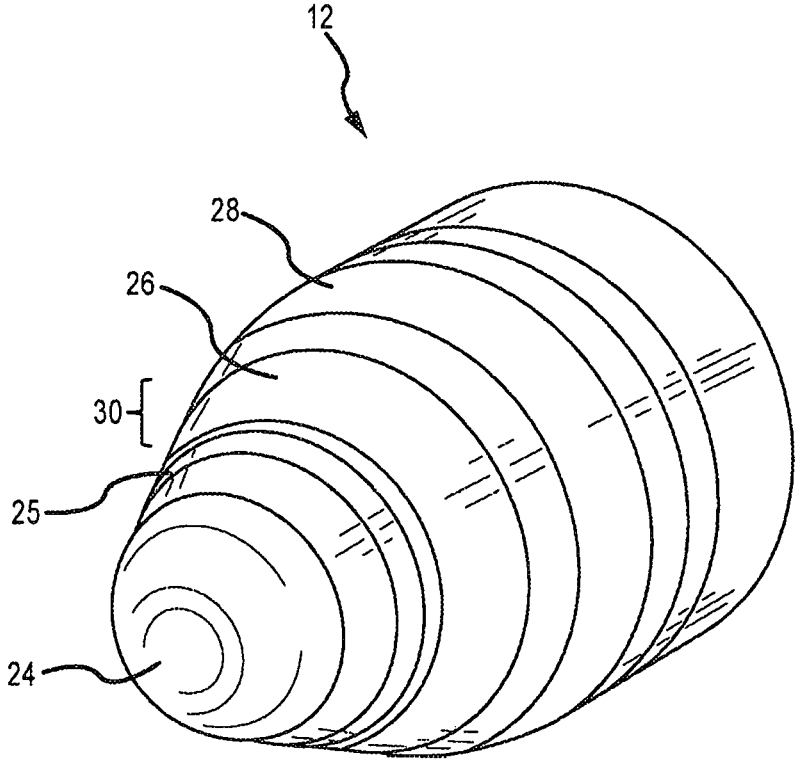
FIGS. 1*a*-1*d* are a perspective, perspective with RF radome and metal cover removed, sectional and axial view of a missile having a conformal broadband antenna array positioned about a cylindrical payload volume.
Figure 1B:
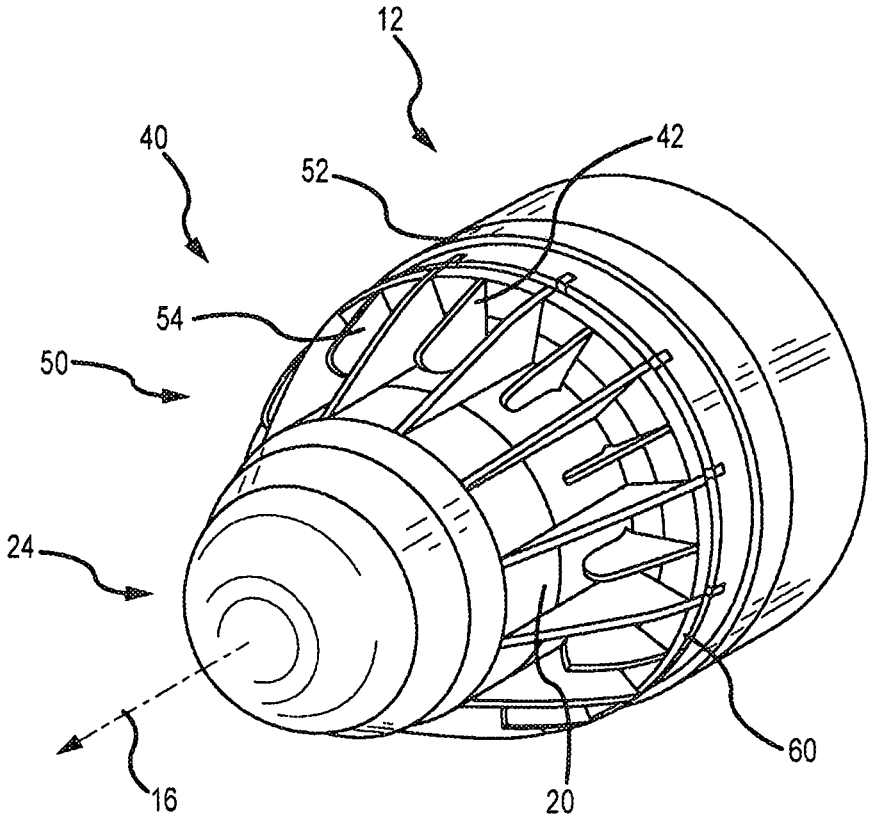
Figure 1C:
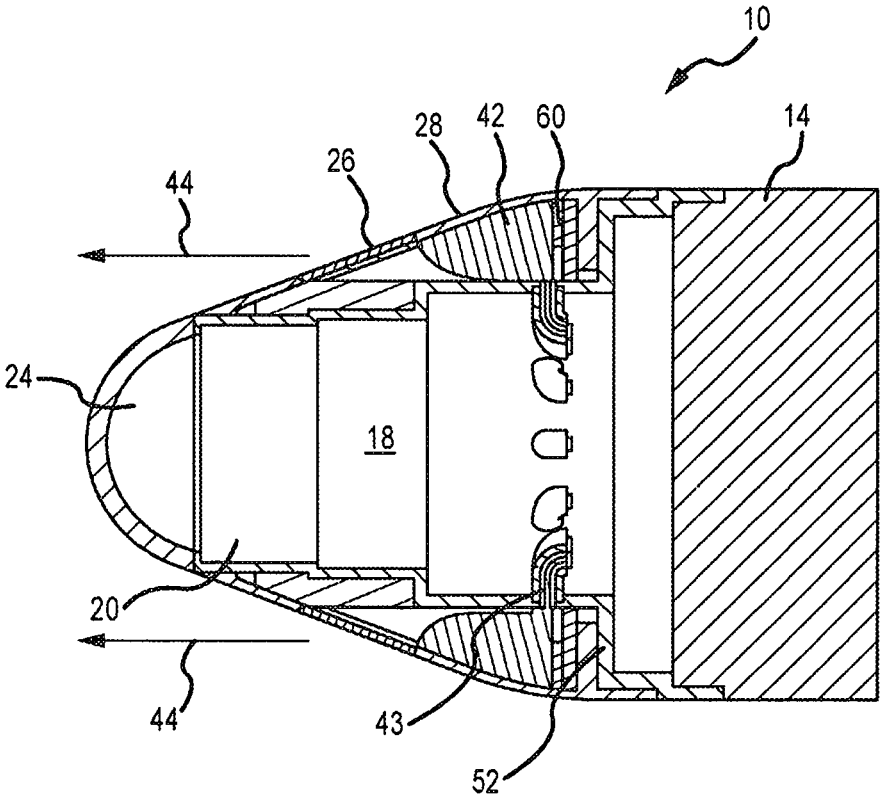
Figure 1D:
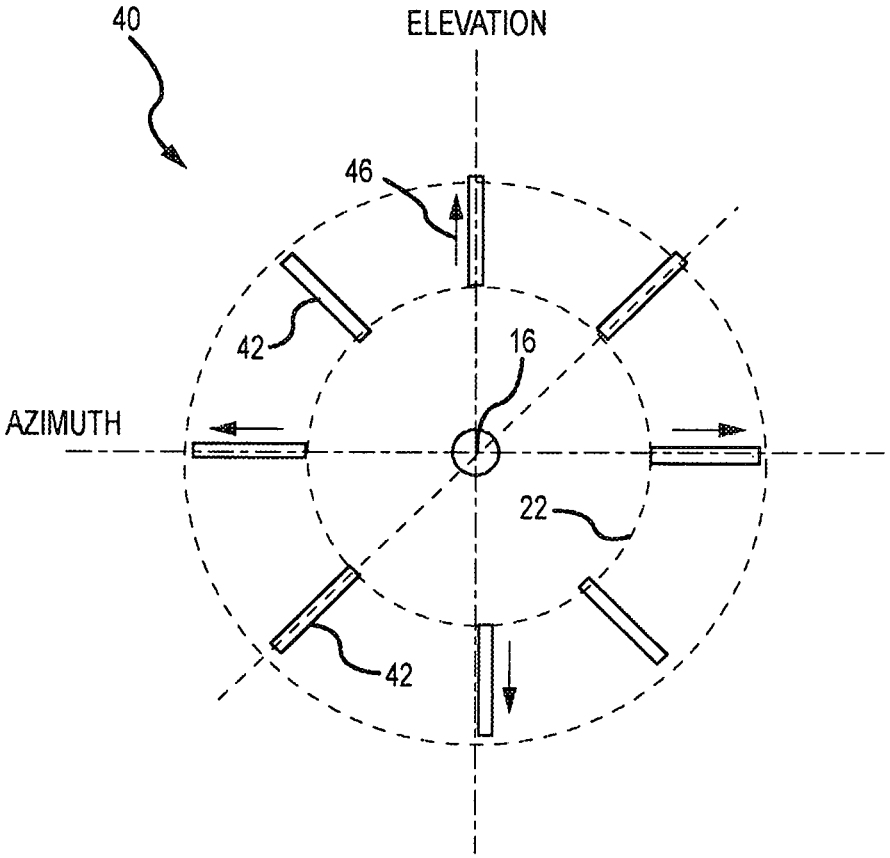

The present invention describes a conformal broadband directional antenna array for a missile that is more compact and exhibits a more desirable forward radiation pattern inclined towards boresight than the inclined slotline antenna array described in U.S. Pat. No. 4,220,330. Additional embodiments further improve the directionality and isolation of adjacent antenna elements. In addition, one or more antenna elements may be configured to launch RF energy backwards inclined towards a longitudinal axis of the missile to form, for example, a data link.

The antenna elements are configured to send and receive "broadband" RF energy. Broadband is defined to mean a bandwidth of at least 100% of the center frequency, and more typically at least 3-to-1. The bandwidth occupies a portion of the spectrum from 50 MHz to 100 GHz, and typically within 100 MHz to 50 GHz. For example, an antenna array may be designed for 1-20 GHz or for 20-40 GHz.

Referring now to FIGS. 1*a* through 1*d*, an embodiment of a missile 10 comprises a nose cone 12 mounted on a missile body 14. A boresight axis 16 extends longitudinally through the missile body 14 and nose cone 12. Nose cone 12 houses a payload 18. In this example, payload 18 comprises an optical seeker. Alternately, the payload may comprise an RF seeker, propellant or an explosive or kinetic warhead, for example. Payload 18 has a metal skin 20, which has a circular cross section 22 normal to boresight axis 16. Payload 18 may be cylindrical (constant diameter cross section) or conical (increasing diameter aft-to-fore). Nose cone 12 includes an optical radome 24 on-axis, an annular metal cover 25, an annular RF radome 26 around and aft of the optical radome 24 and an annular metal cover 28 around and aft of annular RF radome 26. RF radome 26 defines an RF aperture 30 for transmission of RF energy. The optical radome 24 and RF radome 26 are suitably formed of dielectric materials designed to transmit the respective optical and RF bands.

A conformal broadband directional antenna array 40 comprises a plurality of ½ flared notch radiators 42 recessed within the nose cone 12 and positioned in a circumferential arrangement around and extending radially from the payload's metal skin 22 to contact the annular metal cover 28 that provides a ground plane such that each ½ flared radiator is parallel to boresight axis 16. An RF feed 43 is coupled to the slotline of the ½ flared notch radiator. In general, the ½ flared radiator is inclined towards boresight with an angle $\alpha$ measured off of boresight where $0 \leq \alpha < 90$ degrees. The payload's metal skin 20 provides an image plane for each ½ flared notch radiator to launch RF energy 44 with a radial polarization 46 normal to the image plane forward through the annular RF radome 26 and RF aperture 30.

To improve directionality and isolation, each ½ flared notch radiator 42 is suitably confined in a 5½ sided waveguide 50. The payload's metal skin 20, an annular metal backplane 52 such as formed by a step in the payload, a pair of metal septums 54 to either side of the radiator 42 and the annular metal cover 28 define the 5½ sided waveguide. The ½ flared notch radiators 42 and septums 54 alternate about the circumferential arrangement. The annular metal cover 28 covers both the top of the waveguide and a portion (not necessarily ½) of the $6^{th}$ side above (or below) the RF aperture 30. Instead of being flat on top, the ½ flared notch radiator 42 is extended so that it contacts the metal cover just outside and aft of RF aperture 30. The septum-to-septum spacing is such that a cutoff frequency fcut of the waveguide, which acts as a high pass filter, is below the bandwidth of the antenna array. Nominally, this spacing is approximately one-half the center wavelength $\lambda c$.

In an embodiment, an RF absorbing material 60 is positioned aft of each ½ flared notch radiator 42 between the radiator and the annular metal backplane 52. RF absorbing material 60 is positioned both behind and radially beyond the RF aperture 30 to increase absorption. RF absorbing material may also be positioned on the septums between radiators. The RF absorbing material serves to absorb the energy (E-field) that is propagating backwards. By absorbing the energy, the material prevents the energy from bouncing off the back plane (which it would do if it were uncoated metal) and then propagating forward and adding constructively and destructively to the energy already going forward from the ½ flare. A common RF absorbing material is ECCOSORB® produced by Emerson & Cuming Microwave Products, Inc.

Figure 2:
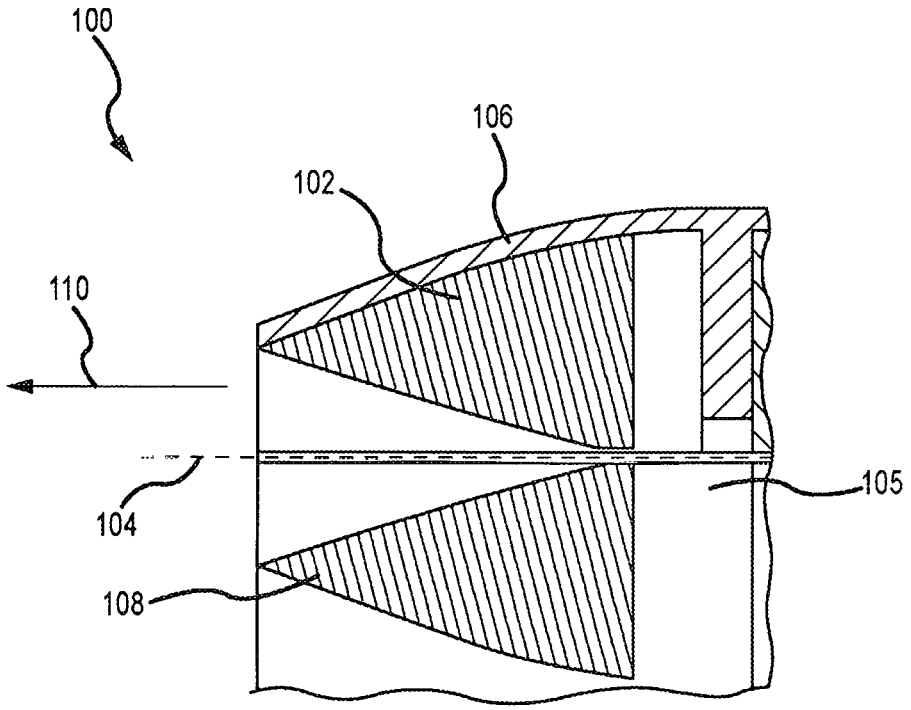
FIG. 2 is a sectional view of a ½ flared notch radiator and its image element about the image plane.

Referring now to FIG. 2, an antenna element 100 comprises a ½ flared notch radiator 102 that extends radially from an image plane 104 formed at the surface of the payload's metal skin 105 to contact a ground plane 106 (e.g. the annular metal cover). The ½ flared notch radiator 102 is suitably a metal layer on a dielectric substrate in which the metal layer is patterned with an exponential taper from the slotline (input) that is spaced apart from image plane 104 to the antenna output. Image plane 104, which is just another ground plane, creates an image 108 of the ½ flared notch radiator 102, which together approximate a full flared notch radiator that launches RF energy 110 forward parallel to the image plane. The phenomenon is similar to the case of a monopole over an infinite ground plane, which will have the same predicted performance as a dipole in free space.

An example of a ½ flared notch radiator was described by Xavier Artiga et al., "Halved Vivaldi Antenna With Reconfigurable Band Rejection", IEEE Antennas and Wireless Propagation Letters, Vol. 10, pp. 56-58, 2011, which is hereby incorporated by reference, in which only half of a Vivaldi antenna is used and placed over a flat ground plane. Artiga discloses the structure and principle of using the ground plane to create an image of the halved Vivaldi to approximate a full Vivaldi.

The current antenna element 100 differs from the Halved Vivaldi Antenna in a number of critical aspects. First, antenna element 100 includes ground planes 104 and 106 both below and above the ½ flared notch radiator whereas the Halved Vivaldi Antenna only includes the ground plane below. Second, ½ flared notch radiator 102 is extended to contact ground plane 106 outside and just aft of the RF aperture whereas the top surface of the Halved Vivaldi is flat. Third, ground planes 104 and 106 each have a circular cross-section owing to the shape of the missile payload and annular metal cover of the nose cone whereas the Halved Vivaldi Antenna's ground plane is flat.

Figure 3A:
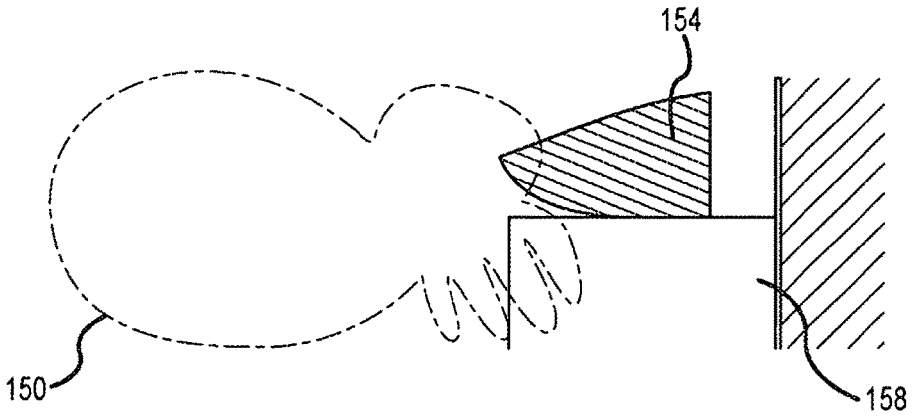
FIGS. 3*a* and 3*b* are diagrams comparing the radiation patterns of the ½ flared notch radiator and a full flared notch radiator above an image plane.
Figure 3B:
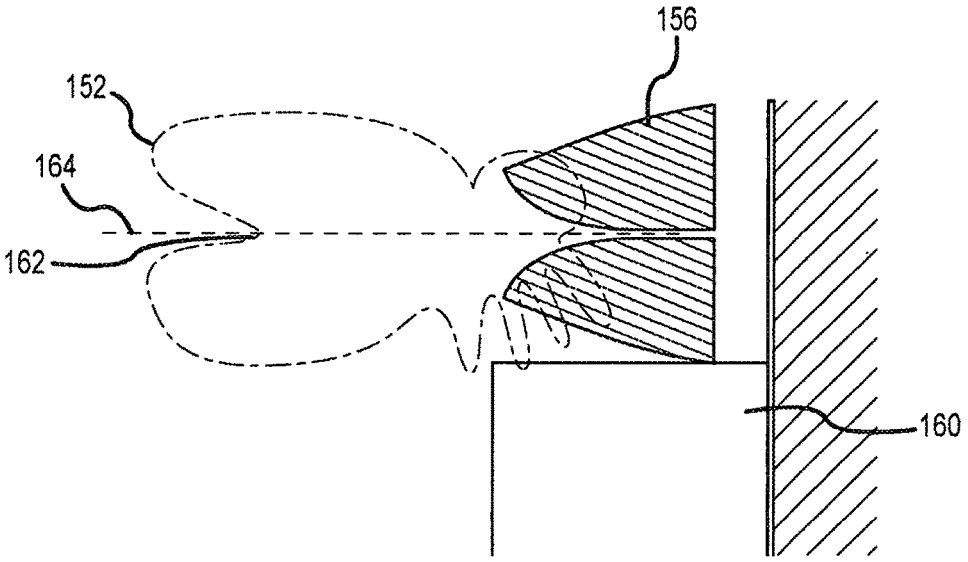
FIG.3b (PRIOR ART)

Referring now to FIGS. 3*a* and 3*b*, antenna radiation patterns 150 and 152 are shown for the ½ flared notch radiator 154 of the present invention and the full flared notch radiator 156 disclosed by Salvail, respectively. Image plane 158 creates an image of the ½ flared notch radiator 154 to approximate a full flared notch radiator that that emits the smooth radiation pattern 150 having a maximum on boresight. Image plane 160 creates an image of the full flared notch radiator 156 to approximate a 2-element array of full flared notch radiators that emits radiation pattern 152 having a null 162 on boresight axis 164 at some frequencies in the useable bandwidth, which is undesirable.

In another embodiment the payload is conical about the boresight axis. Thus the image plane is inclined to boresight. Each ½ flared notch radiator launches RF energy nominally parallel to the image plane and inclined to the boresight axis at angle $\alpha$ where 0 degrees $<\alpha<90$ degrees.

Figure 4:
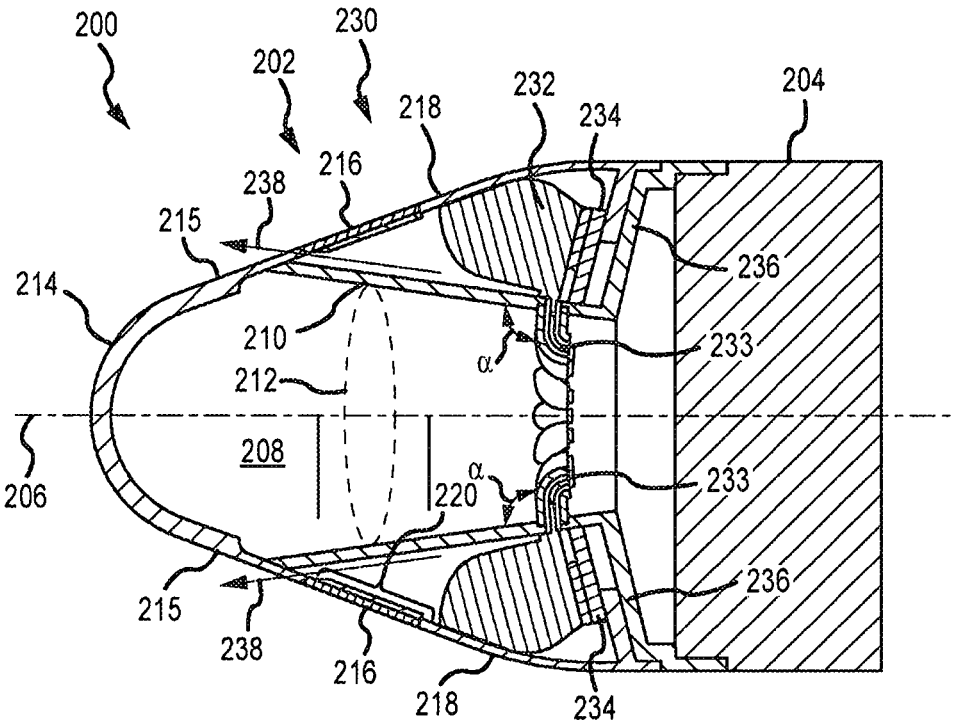
FIG. 4 is a section view of a missile having a conformal broadband antenna array positioned about a conical payload volume.

Referring now to FIG. 4, an embodiment of a missile 200 comprises a nose cone 202 mounted on a missile body 204. A boresight axis 206 extends longitudinally through the missile body 204 and nose cone 202. Nose cone 202 houses a payload 208. In this example, payload 208 comprises an optical seeker. Alternately, the payload may comprise an RF seeker, propellant or an explosive or kinetic warhead, for example. Payload 208 has a metal skin 210, which has a circular cross section 212 normal to boresight axis 206. Payload 208 is conical (increasing diameter aft-to-fore). Nose cone 202 includes an optical radome 214 on-axis, an annular metal cover 215, an annular RF radome 216 around and aft of the optical radome 214 and an annular metal cover 218 around and aft of annular RF radome 216. RF radome 216 defines an RF aperture 220 for transmission of RF energy. The optical radome 214 and RF radome 216 are suitably formed of dielectric materials designed to transmit the respective optical and RF bands.

A conformal broadband directional antenna array 230 comprises a plurality of ½ flared notch radiators 232 recessed within the nose cone 202 and positioned in a circumferential arrangement around and extending radially from the payload's metal skin 210 to contact the annular metal cover 218 that provides a ground plane such that each ½ flared radiator inclined to boresight axis 206. An RF feed 233 is coupled to the slotline of the ½ flared notch radiator. RF absorbing material 234 is positioned between the ½ flared notch radiator 232 and a back plane 236. Each radiator may be positioned in a 5½ sided waveguide as previous described to improve directionality and isolation. In general, the ½ flared radiator is inclined towards boresight with an angle $\alpha$ measured off of boresight where $0<\alpha<90$ degrees. The payload's metal skin 210 provides an image plane for each ½ flared notch radiator to launch RF energy 238 with a radial polarization normal to the image plane forward through the annular RF radome 216 and RF aperture 220.

Figure 5:
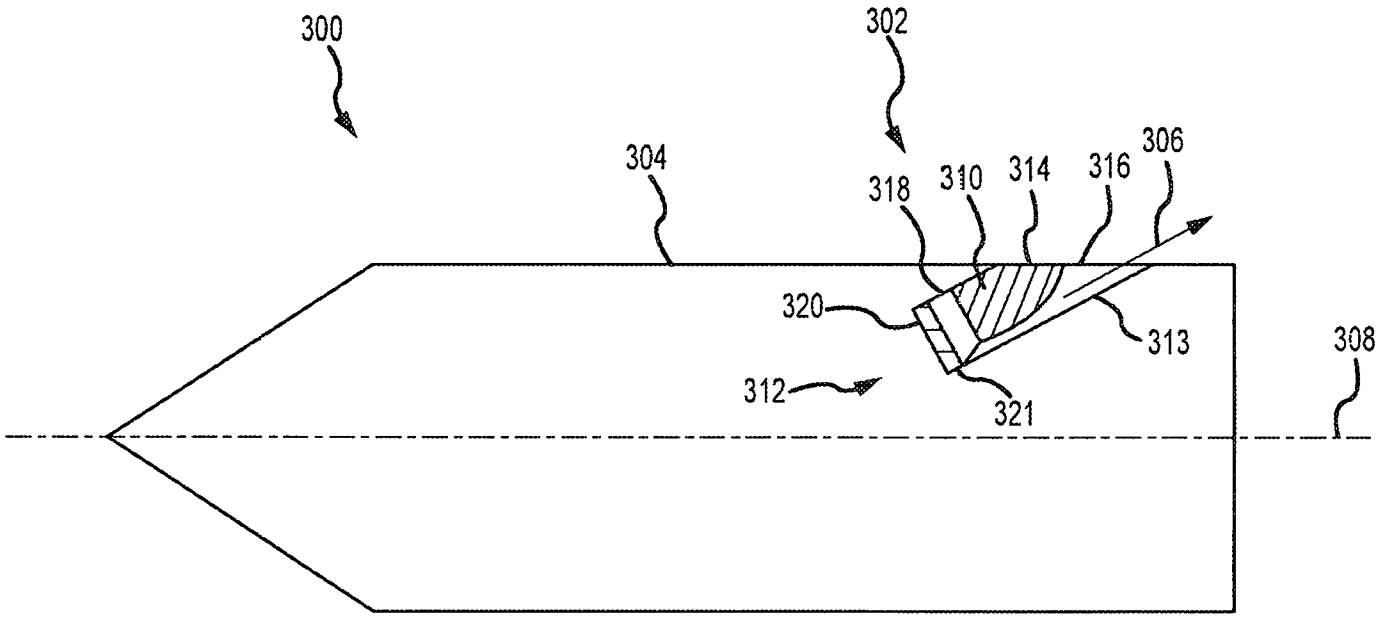
FIG. 5 is a sectional view of an antenna pocket in which a ½ flared notch radiator is positioned in a 5½ sided waveguide to launch RF energy backwards through an RF window in the fuselage to serve as a data link antenna.

Referring now to FIG. 5, a missile 300 may comprise a conformal broadband directional antenna 302 recessed within a missile body 304 to launch RF energy 306 rearward inclined towards a longitudinal axis 308 of the missile body. Conformal broadband directional antenna 302 includes a ½ flared notch radiator 310 positioned inside a 5½ sided waveguide 312 to improve directionality and isolation. The missile may have 1, 2 or 4 such antennas 302 spaced around the circumference of the missile body. The antenna may, for example, be used as a rear facing data link.

The 5½ sided waveguide 312 comprises an image plane 313 (flat or circular) inclined towards longitudinal axis 308, a portion 314 of the missile body having a circular cross section opposite the image plane, an RF window 316 formed in the missile body aft of portion 314 and abutting one end of the image plane, a ground plane 318 having a circular cross section spaced apart from the image plane and abutting the missile body, a back plane 320 that abuts the image and ground planes and a pair of sidewalls (not shown) between the image and ground planes that abut the backplane and the portion of the missile body. Each side of the waveguide (e.g. the image plane, ground plane, back plane, portion of the missile body and sidewalls) are formed of metal except the RF window.

The ½ flared notch radiator 310 extends radially from the image plane 313 to contact the ground plane 318 and the portion 314 of the missile body such that the ½ flared radiator is inclined towards the longitudinal axis 308 and isolated within the 5½ sided waveguide 312. RF absorbing material 321 is positioned in the waveguide between the radiator and back plane 320. The image plane forms an imaged radiator of ½ flared notch radiator 310 to approximate a full flared notch radiator to launch RF energy 306 with a linear polarization normal to the image plane 313 rearward through the RF window 316.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. An antenna array for a missile nose cone, said missile nose cone having a payload having a metal skin with a circular cross section normal to a boresight axis, an annular RF radome around said payload and an annular metal cover around and aft of the annular RF radome, said antenna array comprising a plurality of ½ flared notch radiators recessed within the nose cone and positioned in a circumferential arrangement around and extending radially from the payload's metal skin to contact the annular metal cover that provides a ground plane such that each ½ flared radiator is inclined towards the boresight axis, the payload's metal skin providing an image plane for each ½ flared notch radiator to launch RF energy with a radial polarization normal to the image plane forward through the annular RF radome.

2. The antenna array of claim 1, wherein each said ½ flared notch radiator launches RF energy in a broadband bandwidth of at least 100 percent of a center frequency, said broadband bandwidth occupying a portion of the electromagnetic spectrum in the 50 MHz to 100 GHz band.

3. The antenna array of claim 1, wherein the payload occupies at least 50% of the volume of the nose cone.

4. The antenna array of claim 1, wherein said image plane creates an imaged ½ flared notch element of each said ½ flared notch element that together approximate a full flared notch element.

5. The antenna array of claim 1, wherein said image plane and said ground plane each have a circular cross-section normal to the boresight axis.

6. The antenna array of claim 1, wherein said payload comprises one of an optical or RF seeker, propellant or an explosive or kinetic warhead.

7. The antenna array of claim 1, wherein the payload is cylindrical about the boresight axis, wherein each said ½ flared notch radiator launches RF energy that is nominally parallel to the boresight axis.

8. The antenna array of claim 1, wherein the payload is conical about the boresight axis, wherein each said ½ flared notch radiator launches RF energy that is inclined to the boresight axis at angle $\alpha$ where 0 degrees $<\alpha<90$ degrees.

9. The antenna array of claim 1, wherein the annular RF radome defines an annular RF aperture through which the RF energy is launched.

10. The antenna array of claim 9, wherein each ½ flared notch radiator includes a section that extends radially beyond the RF aperture to contact the ground plane.

11. The antenna array of claim 9, further comprising RF absorbing material positioned aft of each said ½ flared notch radiator both behind and radially beyond the RF aperture.

12. The antenna array of claim 9, further comprising:

an annular metal backplane aft of the circumferential arrangement of said ½ flared notch radiators; and a plurality of metal septums against the metal backplane that extend radially from the payload's metal skin in a circumferential arrangement, alternating with each said ½ flared notch radiator, to contact the annular metal cover, said payload's metal skin, said annular metal backplane, said metal septums and said annular metal cover defining a 5½ sided waveguide about each said ½ flared notch radiator that confines the RF energy to be launched forward through the RF aperture and isolates adjacent ½ flared notch radiators.

13. The antenna array of claim 12, wherein a septum-to-septum spacing is such that a cutoff frequency fc of the waveguide is below a bandwidth of the antenna array.

14. A missile, comprising:

a missile body;

a nose cone mounted on the missile body, said nose cone having a payload having a metal skin with a circular cross section normal to a boresight axis, an annular RF radome that defines an RF aperture around said payload, an annular metal cover around and aft of the annular RF radome and an annular metal backplane aft of the payload; and a conformal broadband directional antenna array comprising a plurality of ½ flared notch radiators and a plurality of metal septums recessed within the nose cone and positioned in an alternating circumferential arrangement around and extending radially from the payload's metal skin beyond the RF aperture to contact the annular metal cover that provides a ground plane such that each ½ flared radiator is inclined towards the boresight axis and isolated within a 5½ sided waveguide, the payload's metal skin providing an image plane for each ½ flared notch radiator that forms an imaged radiator to approximate a full flared notch radiator to launch RF energy with a radial polarization normal to the image plane forward through the RF aperture and annular RF radome.

15. The missile of claim 14, wherein the payload is cylindrical about the boresight axis, wherein each said ½ flared notch radiator launches RF energy that is nominally parallel to the boresight axis.

16. The missile of claim 14, wherein the payload is conical about the boresight axis, wherein each said ½ flared notch radiator launches RF energy that is inclined to the boresight axis at angle $\alpha$ where 0 degrees $<\alpha<90$ degrees.

17. The missile of claim 14, further comprising RF absorbing material positioned each said ½ flared notch radiator and the annular metal backplane both behind and radially beyond the RF aperture.

18. The missile of claim 14, further comprising a conformal broadband directional antenna recessed within the missile body to launch RF energy rearward inclined towards a longitudinal axis of the missile body, said antenna comprising:

a 5½ sided waveguide comprising an image plane inclined towards the longitudinal axis;

a portion of the missile body having a circular cross section opposite the image plane;

an RF window formed in the missile body aft of said portion and abutting one end of the image plane;

a ground plane having a circular cross section spaced apart from said image plane and abutting the missile body;

a backplane that abuts said image and ground planes; and a pair of sidewalls between the image and ground planes that abut the backplane and the portion of the missile body; and a ½ flared notch radiator extending radially from the image plane to contact the ground plane and the portion of the missile body such that the ½ flared radiator is inclined towards the longitudinal axis and isolated within a 5½ sided waveguide, the image plane forming an imaged radiator for said ½ flared notch radiator to approximate a full flared notch radiator to launch RF energy with a radial polarization normal to the image plane rearward through the RF window.

19. A broadband directional antenna element, comprising:

a 5½ sided waveguide comprising an image plane;

a backplane that abuts said image plane;

a pair of sidewalls on the image plane that abut the back plane and define a forward opening;

a metal cover on the pair of sidewalls opposite the image plane that abuts the ground plane and extends forward to cover a portion of the forward opening; and an RF window that abuts the pair of sidewalls and image plane to cover the remaining portion of the opening to define an RF aperture; and a ½ flared notch radiator extending radially from the image plane beyond the RF aperture to contact the metal cover such that said ½ flared radiator is inclined towards a longitudinal axis axis and isolated within the $51/_2$ sided waveguide, the image plane forming an imaged radiator of the ½ flared notch radiator to approximate a full flared notch radiator to launch RF energy with a linear polarization normal to the image plane through the RF window.

* * * * *